US006189727B1

(12) United States Patent
Shoenfeld

(10) Patent No.: US 6,189,727 B1
(45) Date of Patent: Feb. 20, 2001

(54) PHARMACEUTICAL DISPENSING ARRANGEMENT

(75) Inventor: Norman A. Shoenfeld, Livingston, NJ (US)

(73) Assignee: S&S X-Ray Products, Inc., Brooklyn, NY (US)

( * ) Notice: Under 35 U.S.C. 154(b), the term of this patent shall be extended for 0 days.

(21) Appl. No.: 09/275,130

(22) Filed: Mar. 24, 1999

(51) Int. Cl.[7] ..... G07F 11/00
(52) U.S. Cl. ..... 221/2; 221/279
(58) Field of Search ..... 221/2, 7, 9, 13, 221/131, 123, 129, 179, 226, 230; 700/231, 232

(56) References Cited

U.S. PATENT DOCUMENTS

| | | | | |
|---|---|---|---|---|
| 4,785,969 | | 11/1988 | McLaughlin | 221/2 |
| 5,263,596 | * | 11/1993 | Williams | 221/279 |
| 5,292,029 | | 3/1994 | Pearson | 221/2 |
| 5,597,995 | | 1/1997 | Williams et al. | 235/375 |
| 5,713,485 | * | 2/1998 | Liff et al. | 221/2 |
| 5,713,487 | | 2/1998 | Coughlin | 221/2 |
| 5,842,976 | | 12/1998 | Williamson | 600/300 |

* cited by examiner

*Primary Examiner*—Kenneth W. Noland
(74) *Attorney, Agent, or Firm*—Bernhard P. Molldrem, Jr.

(57) ABSTRACT

A semi-automated pharmaceutical dispensing arrangement has a drug cabinet in which a control mechanism permits opening of the front door for an authorized attendant and permits the attendant to obtain the pre-filled bottles or containers of medication for a patient's prescription order. An array of linear dispensing modules each hold a front-to-back row of filled containers, which can be manually lifted out one at a time. A pusher mechanism in the module pushes the containers forward, so that containers are pushed into position for removal. These may be spring actuated. Each of the modules also has an associated signaling device, such as an LED that lights up to guide the attendant to the appropriate dispensing module. A controller processor, e.g., a computer, is associated with the cabinet for inputting patient-medication information and lighting the signaling LEDs for the modules. When the correct medicine is taken from the cabinet, an audible sound is provided and when an incorrect container is taken out, a different audible signal is sounded. Restocking the modules is limited only to authorized pharmacy staff with the proper access codes.

16 Claims, 7 Drawing Sheets

PHARMACEUTICAL DISPENSING ARRANGEMENT

BACKGROUND OF THE INVENTION

This invention relates to a device or arrangement for dispensing various medications that have been prescribed for patients, and is more specifically directed to a compact, inexpensive, and simple arrangement for dispensing pre-filled containers of medicaments, which can be capsules, pills, liquids, salves, etc. The invention is more particularly concerned with a semi-automated technique for filling patient prescription orders in a fashion that minimizes both the risk of human error and the occurances of mechanical failure. The invention is favorably applied to a semi-automated pharmaceutical dispensing cabinet that is for use in a hospital, a small satellite pharmacy, a clinic or a doctor's office.

The need for a prescription distribution cart or cabinet has long been recognized, and various medicine cabinets and carts have been proposed previously, in which patient and prescription data are stored on a computer and the stored data are employed in filling prescriptions from an automated cabinet or supply store. An example of an automated drug dispensing system is described in U.S. Pat. No. 5,713,485. In that system, bottles of pills or other prescription drugs are arranged in stacks or vertical bins within a locked cabinet. Patient information is entered into a computer, which actuates a pair of solenoids associated with one of the vertical bins, causing one bottle to drop down from that bin onto a ramp. The bottle then rolls down to a delivery area. In practice, these vertical drug containers can sometimes jam at the locations of the solenoids, and prevent the medication from being dispensed. As the cabinet is locked during dispensing, there is no way for the attendant to unjam the bin involved and correct the situation. Also, the stacks or bins in this arrangement do not keep track of the number of bottles or containers actually remaining in them. Instead, the computer can only keep track of the number of dispensing operations, and assumes that the bins had all been full at the onset.

Other medication dispensing arrangements have also been proposed, and some of these are described, for example, in U.S. Pat. No. 4,785,969; U.S. Pat. No. 5,292,029; U.S. Pat. No. 5,597,995; U.S. Pat. No. 5,713,487; and U.S. Pat. No. 5,842,976.

However, none of these proposes a simple, reliable semi-automated drug dispensing cabinet that minimizes both human error and mechanical problems, and which can serve in a wide variety of health care environments.

OBJECTS AND SUMMARY OF THE INVENTION

Accordingly, it is an object of the present invention to provide a drug dispensing cabinet that avoids the drawbacks of the prior art.

It is another object to provide a semi-automated dispensing cabinet with a locked door that opens to an authorized attendant upon entry of an authorization code (e.g., by way of a magnetic or bar-code card or badge, or by entry of a PIN).

It is a further object to provide a drug dispensing cabinet in which bottles or containers in the cabinet are automatically identified for selection for the authorized attendant, and provides visual or audible feedback to the attendant when the correct container has been lifted out and also when an incorrect container has been lifted out.

In accordance with an aspect of the present invention, a semi-automated pharmaceutical dispensing arrangement provides a nurse, pharmacist, or other medical/pharmacy attendant with one or more filled containers to satisfy a prescription order for a patient. A drug cabinet has an enclosure or housing and a front door. The door is kept locked normally, but a control mechanism permits opening of the front door for an authorized attendant and permits the attendant to obtain the pre-filled bottles or containers of prescription medication to satisfy a patient's prescription order. Within the cabinet is an array of linear dispensing modules, each module containing a front-to-back row of containers filled with a particular respective medicament. Each module includes means to permit containers to be manually lifted out from the front of the module one at a time by the attendant. A pusher mechanism in the module pushes the containers forward, so that when one container is lifted out another container behind it is pushed into position for removal. The modules each include means for accounting for the number of containers in the respective module. Each of the modules also have an associated signaling device, such as an LED that lights up to identify to the attendant the module from which a container is to be taken to satisfy the patient prescription order. A controller processor is associated with the cabinet, and can be, for example, a small stand-alone computer, or a central computer that is networked into one or several of these cabinets. The controller processor includes means for inputting patient-medication information and provides a signal to the signaling means of the appropriate one of the modules in the cabinet that contains the medicament prescribed for that patient.

The dispensing module favorably includes a sensor to detect when a container has been removed from it. In response to this, the controller processor generates a first indication, i.e., an audible tone or chime, when the attendant has removed the container, from the correct module, that contains the prescribed medicament for the patient. If the attendant mistakenly takes a container from a different module, a second indication is generated, i.e., another alarm tone or buzzer, to alert the attendant that he or she has taken a container from the wrong module. In this latter case, there is a return cabinet into which the attendant can place the container. The return container has a drop-only bin into which the containers can be inserted but not removed, and a door that can be opened only by authorized pharmacy personnel to collect the mistakes or return containers.

In each of the modules there are guide means for holding said containers in a row and guiding them as they are pushed from back to front. The pusher mechanism biases against a final one of the containers to push it forward, and a sensor device tracks the position of the final container in the respective row. This position corresponds to the number of containers in the module that remain to be dispensed. The sensor device can be a rotary sensor, such as a potentiometer, encoder wheel, or the like. These have the advantage of maintaining their state in the event of a power outage. Alternatively, the sensor can include an optical, magnetic, or other presence sensor that travels with the pusher mechanism and detects indicia such as reflectors, teeth on a locator bar, or the like, corresponding to the positions of the medicine containers in the row.

In one preferred mode there are forty of these modules in the cabinet, arrayed eight across and five high. There could be more or fewer modules, depending upon the specific user application.

The method of semi-automatically dispensing prescribed medication, and filling a prescription order for a patient, can be easily carried out using the cabinet of this invention. The nurse, pharmacist, health practitioner, or other attendant inputs patient and/or prescription data into the associated computer or processor device. This may include an employee PIN to gain access to the cabinet, and patient identification. The patient's medical and prescription information may be already contained in the computer. Each of the modules has an LED or other signaling means that lights to identify to the attendant that module from which to lift out a container to satisfy the patient's prescription. Then the attendant lifts out the container from that module. The container is scanned, e.g., using a bar code scanner, to verify that this is the medication that is intended. An associated printer prints out a label, with prescription information and instructions for the patient concerning administration of the medication. This may then be affixed onto the container.

When the attendant selects the container from the indicated module, a sounder generates an audible tone to confirm that this was a correct action. However, if he or she incorrectly lifts out a container of medication from a different module, then a different sounder, i.e., a buzzer, puts out another audible alarm to alert the attendant that the wrong medication has been selected. In that case, the system instructs the attendant to place the container into the return cabinet. The modules do not permit the attendant to re-insert the container, and only authorized pharmacy staff with refilling privileges are permitted to access the cabinet for the purpose of re-stocking the modules.

When the attendant is finished with pulling out and labeling the containers for the patient's prescription order, the application software instructs the attendant to shut the cabinet door. Then, the cabinet detects that the door has been shut, and sends an acknowledgment to the computer, which awaits input of patient data for another patient's prescription.

The unit may be positioned on a table top or counter top, on a wall, or on a custom cart.

The above and many other objects, features, and advantages of this invention will become apparent from the ensuing description of a selected preferred embodiment, which is to be considered in connection with the accompanying Drawing.

DETAILED DESCRIPTION OF THE PREFERRED EMBODIMENT

Figure 1:
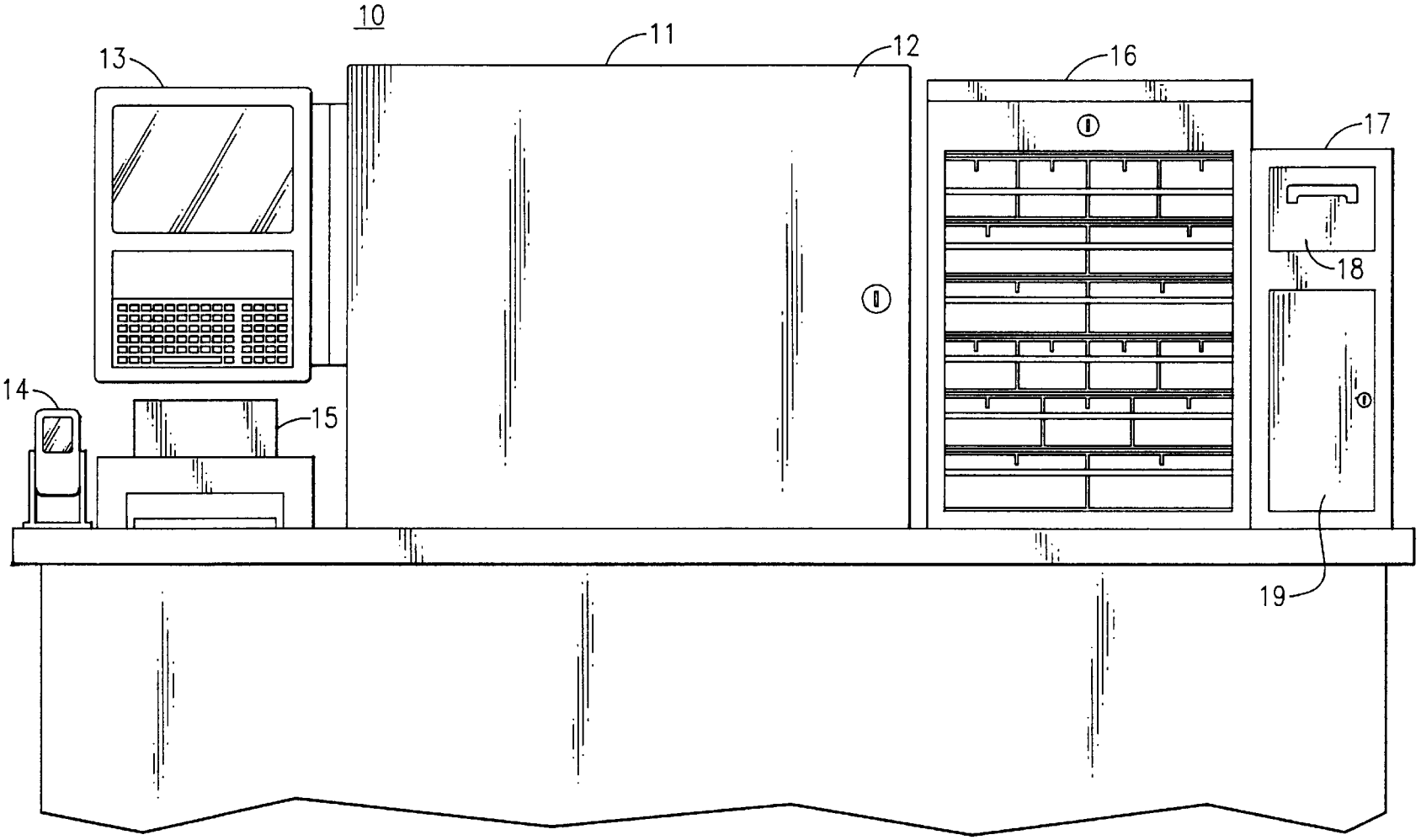
FIG. 1 is a front elevation of a medicament dispensing arrangement according to one preferred embodiment of the invention.
Figure 2:
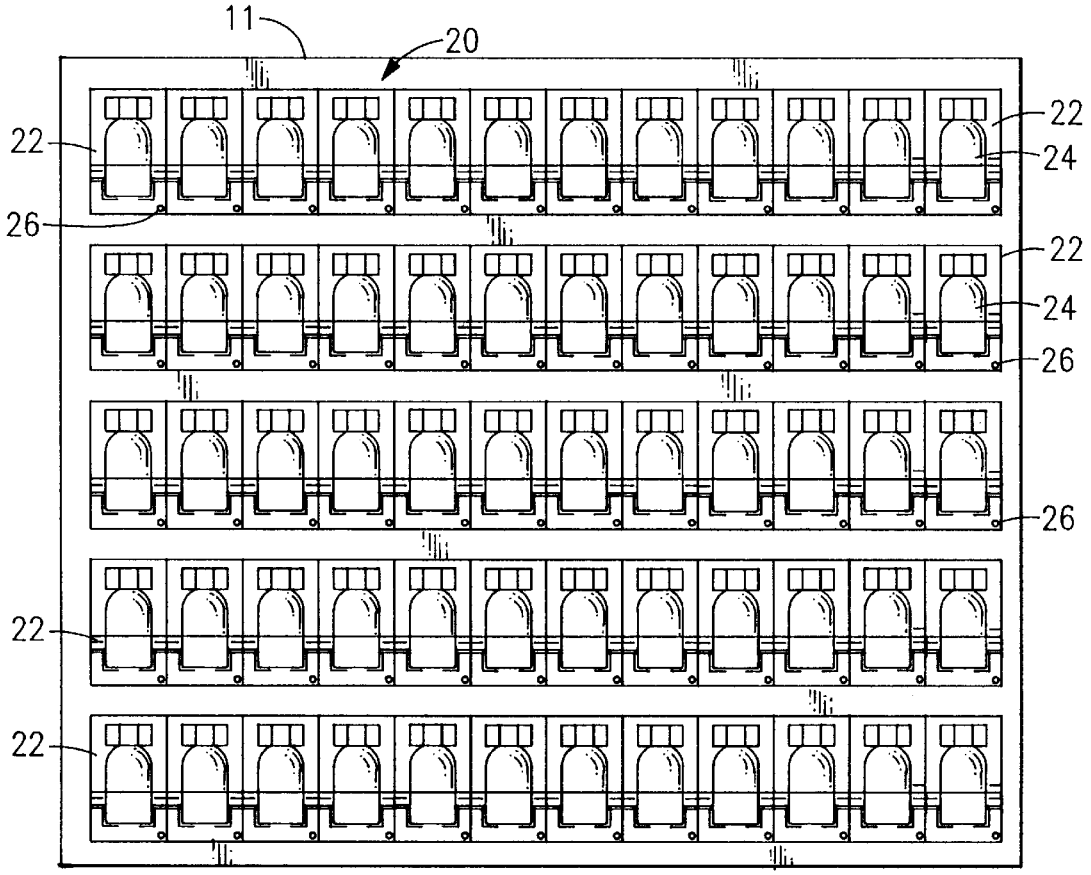
FIG. 2 is a front elevation of the dispensing cabinet of this embodiment, shown with the door opened and providing access to the dispensing modules within.

With reference to the Drawing, and initially to FIGS. 1 and 2, a pharmaceutical or medicine dispensing system 10 has a clinical dispensing cabinet 11 which is an enclosure having a lockable front door 12. A computer 13 serves as a controller for the system, and can take on any of a wide variety of forms. Here, the computer 13 is a Datalux computer system with a touch screen and a fold-down keyboard. There is cabling (not shown) that connects the computer 13 with the cabinet 11 and with other ancillary equipment. A bar-code scanner or reader 14, here shown as pedestal mounted, is used for reading bar code labels on medicine containers, to be discussed later, and may also be employed to read in bar-coded patient and prescription information. A label printer 15 (here an ink-jet printer) is used for printing labels for the medicine containers, to include prescription information and instructions for the patient.

An auxiliary cabinet 16 is positioned next to the cabinet 11, and is of a three-tier, multiple-drawer configuration. This cabinet is kept locked and is unlocked by authorized personnel for dispensing additional medications, either prescription or non-prescription. A return cabinet 17 provides a place for return of medications removed by mistake from the cabinet 11. This cabinet 17 has a drop drawer 18, through which bottles or containers can be dropped into the cabinet, but which does not permit access into the cabinet for removal of containers. A locked door 19 permits access by authorized pharmacy staff.

FIG. 2 shows the cabinet 11 with the door 12 opened, to expose an array 20 of container dispensing modules 22. In this embodiment there are forty modules 22 in the array 20, arranged five modules high and eight modules across. In other embodiments there can be more (or perhaps fewer). Each module 22 is filled with a row of bottles or similar containers 24 that are pre-filled with a given medication. In this embodiment, each module holds twelve containers 24. The modules are arranged in the cabinet 11 so that the containers form a row from back to front, with a first one only of the containers 24 being accessible to be lifted out of the module. The containers 24 can be removed one at a time from a given module. Here the containers 24 are standard pharmaceutical containers of generally cylindrical shape, with a diameter of about 1½ inches and a height of about 3¼ inches. The cap diameter is the same as for the container body.

On the front of each module 22 is a visible indicator 26, e.g., an LED, that lights to identify which medication is to be lifted out to fill the particular patient's prescription order.

Figure 3:
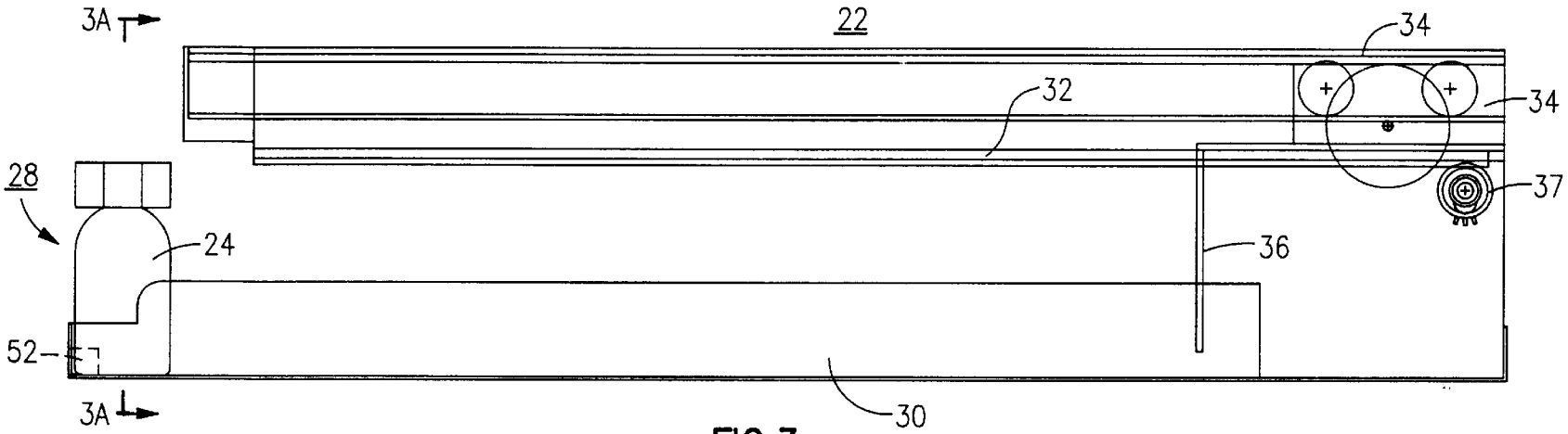
FIG. 3 is a side elevation of one dispensing module of this embodiment.
Figure 3A:
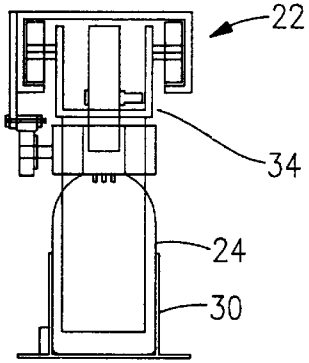
FIG. 3A is a front view of the dispensing module of this embodiment.

The module 22 according to one possible embodiment of this invention is shown in FIGS. 3 and 3A. Here the module 22 is shown with an open front end 28 that presents only the forwardmost bottle or container 24 for removal. A guide channel 30 in each module keeps the containers 24 in line and lets them slide forward as those ahead of them are removed. A gear rack 32 is positioned the length of the module, here above the containers 24. A pusher mechanism for urging the containers forward includes a car or traveler 34 that carries a pusher plate 36, and which moves from back to front along the gear rack. The pusher plate 36 pushes against the rearmost of the containers to urge the row forward each time a container is dispensed.

An index wheel 37 mounted on the traveler 35 rotates when it moves along the gear rack. This can turn a potentiometer or a rotary encoder to provide a signal whose level or other characteristic indicates the position of the pusher mechanism, and hence indicates the number of containers remaining in the module. There can be a gearing mechanism between the wheel 37 and the associated encoder or potentiometer.

Figure 4:
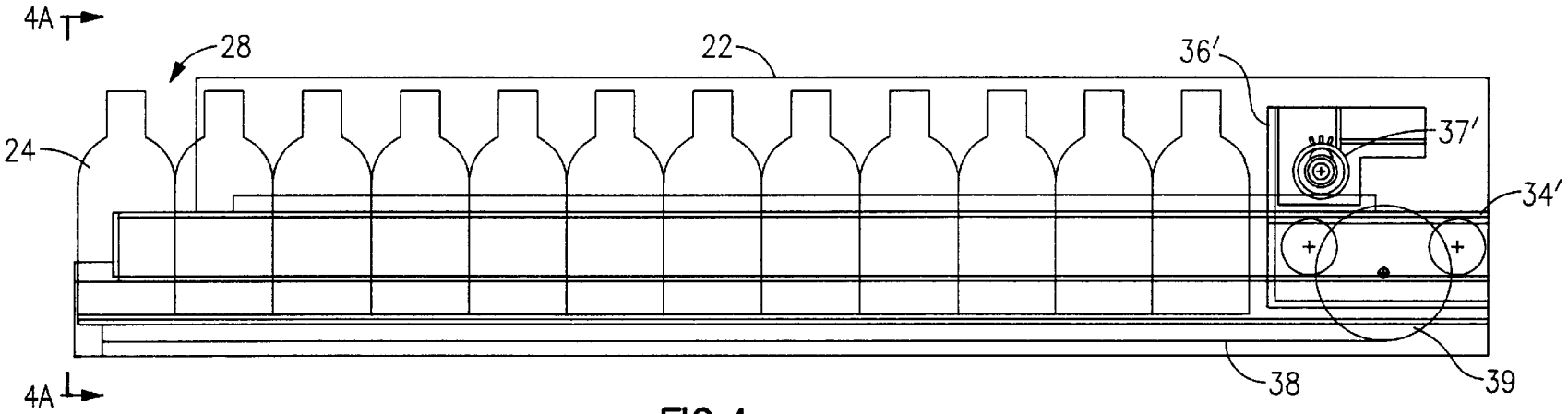
FIG. 4 is a side elevation and FIG. 4A is a front view of an alternative dispensing module.
Figure 4A:
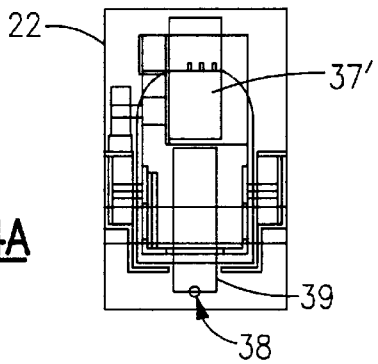

FIGS. 4 and 4A show a module 22 according to another embodiment, similar to that of FIGS. 3 and 3A, in which similar elements are identified with the same reference numbers, and those that are altered have a reference number that is primed. Here, the difference is that the traveler 34' is supported from beneath and is situated with the gear rack 32' towards the lower half of the module. A spring driven mechanism rotates a wheel 39 that draws in a cable 38 that is also anchored at the front end of the module. The spring mechanism maintains tension on the cable 38, so that the traveler 34' biases the pusher plate 36' forward to urge the row of containers 24 in the direction towards the opening 28.

Figure 5:
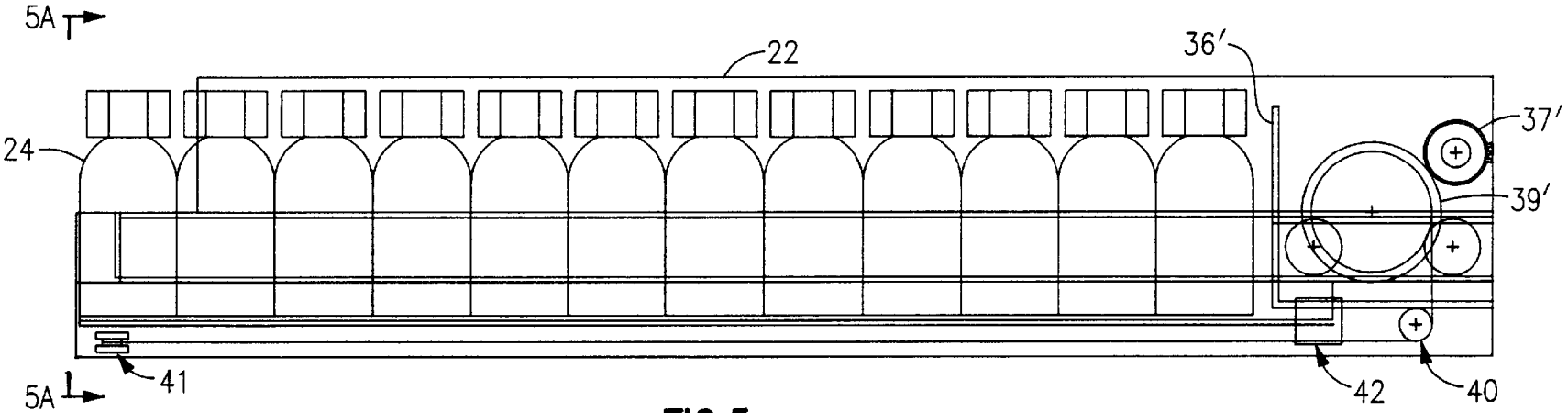
FIG. 5 is a side elevation and FIG. 5A is a front view of an alternative dispensing module.
Figure 5A:
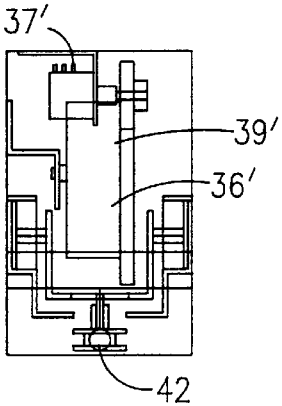

FIGS. 5 and 5A illustrate another embodiment in which the module 22 has an alternative cable driven arrangement for the traveler 34'. Here, the cable 38 is attached to run beneath the containers 24, as in FIG. 4, but runs over a cable pulley 40 to another cable pulley 41 attached at the front end of the module, and then returns to an anchor 42 on the traveler. Here, the index wheel 37' can be geared to rotate with the spring loaded wheel 39.

Figure 6B:
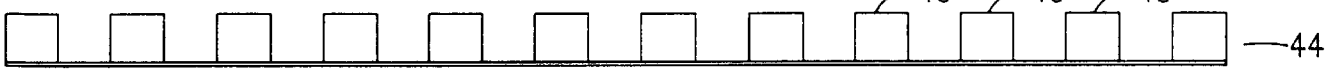
FIG. 6B is a top view of a portion of the dispensing module of FIG. 6.
Figure 6:
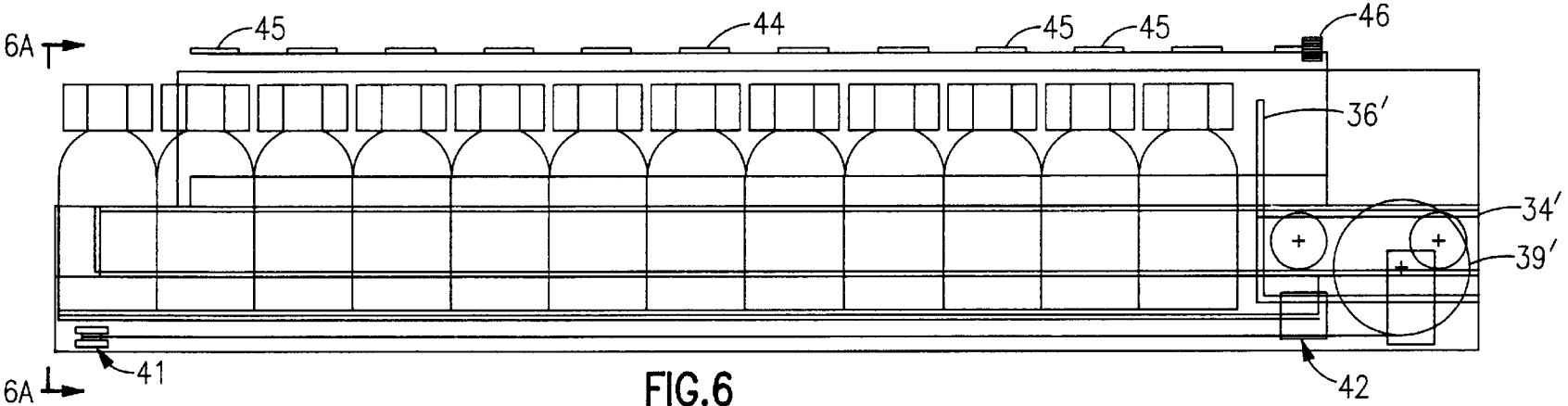
FIG. 6 is a side elevation and FIG. 6A is a front view of an alternative dispensing module.
Figure 6A:
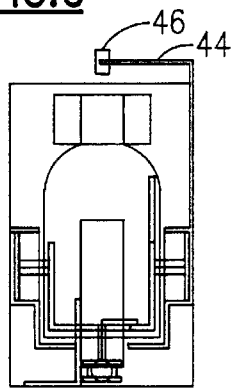

FIG. 6 together with FIGS. 6A and 6B shows another embodiment in which a sensor bar 44 is affixed onto a side wall of the module 22. As shown in FIG. 4B, the bar 44 can have a series of teeth and spaces between the teeth. A presence sensor 46, mounted to move with the traveler and the pusher mechanism, senses the presence and absense of the teeth on the bar 44 as it moves forward. The teeth of the sensor bar 44 have a predetermined pitch that is related to the diameter of the bottles or other containers 24. In this embodiment, the pitch is the same as the diameter of the bottles, but in other embodiments the pitch could be some multiple of this, e.g., five teeth per bottle diameter. This could allow for use of containers that are some fraction of the size of the standard container, or of some larger size. The presence sensor 46 can comprise an LED and a photodetector, so that light passes to the photodetector through the gaps between teeth but is blocked when a tooth is at the location of the sensor. As one possible alternative, a Hall sensor or other magnetic sensor could be used to detect teeth made of a ferromagnetic material.

Figure 7:
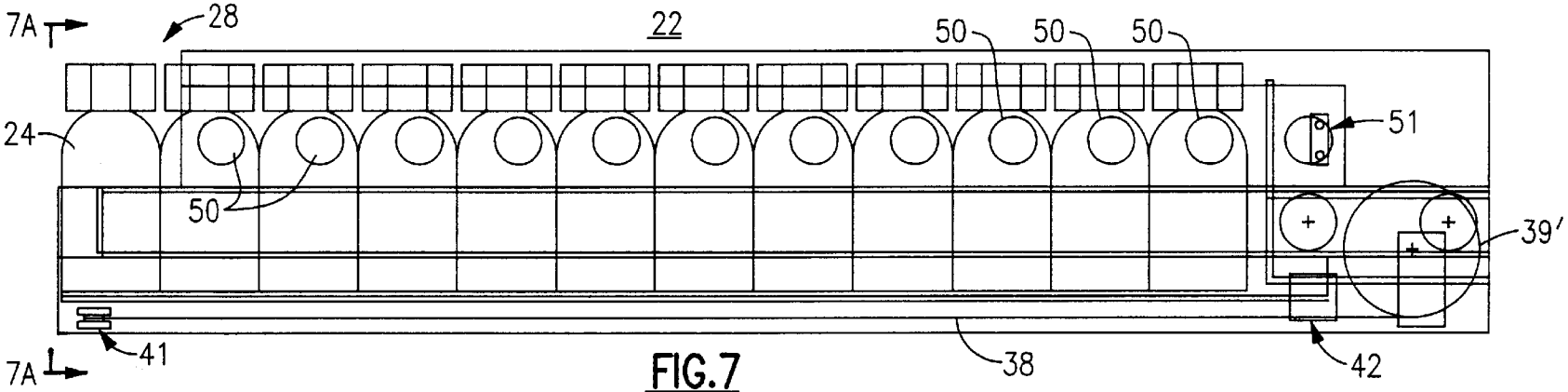
FIG. 7 is a side elevation and FIG. 7A is a front view of an alternative dispensing module.
Figure 7A:
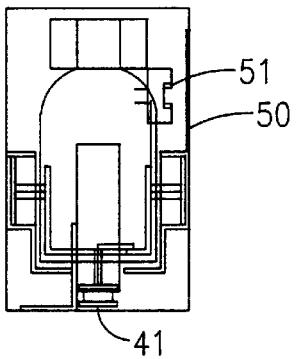

FIGS. 7 and 7A illustrate another embodiment, in which the module 22 has reflectors 50 positioned at intervals along the side wall of the module, and a photo sensor 51, comprising a photo emitter (e.g., LED) and a photodetector, is mounted on the traveler 34'. Here, the reflectors 50 are positioned at intervals corresponding to the positions of the containers 24 when the module is filled. In this case, the computer 13 could count the number of light and dark regions that have been traversed by the sensor 51 to identify the position of the traveller 34'.

Returning to FIG. 3, a micro-switch or similar presence sensor 52 can be located at the forward end of the module 22 to detect when a bottle or container 24 has been removed from the module. This signals such activity to the computer 13. If the container was taken from the proper module as identified by the computer, then a sound will be generated, e.g., a chime, to confirm this to the attendant. On the other hand, if the bottle or container was lifted out from a module not identified by the computer, i.e., with the wrong medication for the patient in question, then the computer will generate a different sound, e.g., a buzzer, to alert the attendant. Then the attendant can place the container taken in error into the return cabinet 16. In other embodiments, the same sensor mechanism as described previously to identify the position of the pusher plate, e.g., the index wheel 37 or 37', or the photo sensor 56 or 51, can also be used to detect that a container has been removed from the module, and actuate these computer-generated sounds.

Generally, the container-dispensing arrangement 10 can be controlled by the local computer 13, as shown, or can be controlled by a pharmacy network computer. A security code is required to open the door 12, and this is entered by the attendant into the computer. Once the door 12 is open, full access to all the pharmaceuticals in the cabinet 11 is permitted. The attendant enters the patient data, which can be simply the patient's name or identity code, or can be the patient's prescription information. In the latter case, the patient's prescription order can be stored on the local computer or on a central computer. After this, the computer will illuminate the LEDs 26 for the appropriate dispensing module(s) 22. This directs the attendant to select the prescribed medication for the patient from the correct location.

Each of the modules carries a bar code (or other kind of label) for the items in that particular row. The containers 24 in each module 22 are similarly bar-coded to identify the medication and for procedural checks to be discussed shortly.

From a given module, the containers 24 are removed one at a time. It two bottles of the same medication are prescribed for the patient, the two containers can be removed sequentially from the module 22, i.e., one after the other, without having to re-access the cabinet. Containers can also be removed from different modules 22 at the same time. Once access to the cabinet is gained, the LEDs 26 direct the attendant to select the correct medication for the patient's prescription order, utilizing inventory control algorithms in the application software. When an item is removed from the correct module, an audible indicator sounds to signify that the medication has been taken from the correct location. Then the LED 26 will extinguish, and the indicator will turn off. On the other hand, if the attendant takes a container from an incorrect module 22, a differently pitched audible indicator will sound to alert the attendant that the wrong medication has been selected. The application software will direct the attendant to return the wrongly dispensed item into the return bin 16. Once this is completed, the attendant can proceed with the dispensing activity. For each of the medications that are on the patient's prescription order, the computer signals to the respective dispenser module 22 to light the selection LED 30.

As the dispensing operation progresses, the bottles or containers in each row are pushed to the front, which keeps the next container to be dispensed at the front of the module. The cabinet 11 and the rest of this arrangement is configured to keep track of which containers have been physically removed from the cabinet at any given time, and for each module 22 the computer keeps track of the position of the last bottle or container. In the embodiment in which the container pusher mechanism causes a potentiometer to turn, the setting of the potentiometer depends only on the position of the pusher mechanism. This means that in the event of a power failure, the position information will be re-captured as soon as power is restored. The index wheel or encoder embodiments can also have this feature. A non-volatile memory can be used to maintain the count of dispensing actions, and thereby the contents of the cabinet. In some of the embodiments discussed above, the pusher mechanism is a spring-powered mechanical drive mechanism. In other embodiments, the pusher mechanism can be motor driven.

Of course, many other possible detecting mechanisms could be employed to detect or identify the position of the rearmost one of the containers 24 in the module 22, that is, the number of containers remaining in the respective module.

The modular cabinet 11 can be configured for different size bottles by using a different size module in place of one or more of the standard modules 22. Alternatively, an insert may be used for a different size bottle or container. For a smaller bottle, an oversleeve or spacer may be used to match the diameter of the standard container 24. Different size bottles or containers will result in a different resistance change in the potentiometer, or a different count on the encoder or other sensor when a container is selected. This can be accounted for in software in the computer 13. As shown here, in this preferred embodiment the cabinet contains 40 modules, i.e., 40 rows of twelve containers each. However, other embodiments can have more, or fewer, modules, and the modules can be configured to accommodate more, or fewer, containers.

In this embodiment, the cabinet is loaded only by authorized pharmacy personnel who must enter an appropriate access code into the computer 13. The containers are loaded into the respective modules 22 from the front end, with the bar code both on the containers and on the modules being scanned for each container loaded. The direction of motion of the pusher mechanism for the module is sensed, and the computer 13 confirms that the pharmaceutical has been properly loaded into the correct dispensing module.

During a dispensing operation, if the attendant attempts to re-load a container back into any of the modules, this will be detected, and will set off an alarm. For this reason, any containers of drugs taken by mistake from the wrong modules must be placed into the return cabinet 16. Only authorized pharmacy staff with refilling privileges will be permitted to reload the cabinet, without setting this alarm off, in order to maintain the integrity of the numbers and contents of the medication containers in the cabinet.

The dispensing process can be briefly explained as follows. First, the attendant, tasked with filling the prescription order for one or more patients, enters his or her access code into the computer 13. Then the attendant enters the applicable patient information and prescription information. If the information is valid, then the front door will be unlocked and will allow access to the medications within the cabinet. The LEDs 26 on the appropriate dispensing modules 22 will be illuminated also to guide the attendant to the proper locations for selecting the medications. The attendant lifts out the container, and the dispenser module detects that one container has been taken. If the medication was taken from the proper module, then the chime will sound to indicate that the dispense action was correct, and the LED 26 will be extinguished. The attendant then brings the container to the bar code scanner 14, and scans the container for a second verification step. If this validates the container as matching the prescription, then the application software directs the printer 15 to print out a label and/or a prescription information sheet for the patient. If more than one medication is indicated on the prescription order, these steps are repeated until the prescription order is filled.

If no further dispense actions are required, the application software instructs the attendant to shut the front door 12 of the cabinet 11. The cabinet 11 detects that the door has been shut, and sends an acknowledgment to the application software. The system then locks the cabinet door 12.

As shown here, the cabinet and the remainder of the dispensing arrangement may be configured to be placed on a counter or table top. Alternatively, the dispensing arrangement may be place on, or incorporated into a custom cart or a suitable vehicle.

The wiring and cabling, not shown here, may be accessed from the rear of the cabinet.

While the invention has been described hereinabove with reference to a preferred embodiment, it should be recognized that the invention is not limited to that precise embodiment. Rather, many modification and variations would present themselves to persons skilled in the art without departing from the scope and spirit of this invention, as defined in the appended claims.

I claim:

1. Semi-automated pharmaceutical dispensing arrangement for providing a medical/pharmacy attendant with one or more filled containers to satisfy a prescription order for a patient, comprising:

a cabinet having a housing, a front door, and a control mechanism opening the front door for an authorized attendant;

an array of linear dispensing modules within the cabinet, each module containing a front-to-back row of containers filled with a particular respective medicament; each module including means at a front end thereof to permit containers to be manually lifted out by the attendant from the front end of the respective row one at a time, means for pushing the containers forward so that when one container is lifted out another container behind it is pushed into position for removal, and means for accounting for the number of containers in the respective module;

each of the modules having an associated signalling means that identifies affirmatively to the attendant the module from which a container is to be taken to satisfy the patient prescription order; and a controller processor including means for inputting patient-medication information and providing a signal to the signalling means of the appropriate one of the modules in the cabinet containing the medicament prescribed for the patient.

2. Semi-automated pharmaceutical dispensing arrangement according to claim 1 wherein said array includes at least forty of said linear dispensing modules.

3. Semi-automated pharmaceutical dispensing arrangement for providing a medical/pharmacy attendant with one or more filled containers to satisty a prescription order for a patient, comprising:

a cabinet having a housing, a front door, and a control mechanism opening the front door for an authorized attendant;

an array of linear dispensing modules within the cabinet, each module containing a front-to-back row of containers filled with a particular respective medicament; each module including means at a front end thereof to permit containers to be manually lifted out by the attendant one at a time, means for pushing the containers forward so that when one container is lifted out another container behind it is pushed into position for removal, and means for accounting for the number of containers in the respective module;

each of the modules having an associated signalling means that identifies to the attendant the module from which a container is to be taken to satisfy the patient prescription order; and a controller processor including means for inputting patient-medication information and providing a signal to the signalling means of the appropriate one of the modules in the cabinet containing the medicament prescribed for the patient; and wherein each said linear dispensing module includes a sensor to detect when a container has been removed therefrom; and said controller processor includes means responsive to said detector to generate a first indication to the attendant when the attendant has removed the container from the module containing the prescribed medicament for the patient; and generating a second indication to the attendant when the attendant has incorrectly removed a container from another such module.

4. Semi-automated pharmaceutical dispensing arrangement according to claim 3 wherein said first indication is an audible sound and said second indication is another audible sound distinct from the first-mentioned audible sound.

5. Semi-automated pharmaceutical dispensing arrangement for providing a medical/pharmacy attendant with one or more filled containers to satisfy a prescription order for a patient, comprising:

a cabinet having a housing, a front door, and a control mechanism opening the front door for an authorized attendant;

an array of linear dispensing modules within the cabinet, each module containing a front-to-back row of containers filled with a particular respective medicament; each module including means at a front end thereof to permit containers to be manually lifted out by the attendant one at a time, means for pushing the containers forward so that when one container is lifted out another container behind it is pushed into position for removal, and means for accounting for the number of containers in the respective module;

each of the modules having an associated signalling means that identifies to the attendant the module from which a container is to be taken to satisfy the patient prescription order;

a controller processor including means for inputting patient-medication information and providing a signal to the signalling means of the appropriate one of the modules in the cabinet containing the medicament prescribed for the patient; and a return cabinet into which the attendant inserts any medicament containers removed in error from the modules in the cabinet.

6. Semi-automated pharmaceutical dispensing arrangement according to claim 5 wherein said return cabinet has a return bin which permits insertion of containers into the return cabinet but does not permit removal of the containers therefrom, and a locked door for permitting only authorized pharmacy personnel to remove containers from the return cabinet.

7. Semi-automated pharmaceutical dispensing arrangement for providing a medical/pharmacy attendant with one or more filled containers to satisfy a prescription order for a patient, comprising:

a cabinet having a housing, a front door, and a control mechanism opening the front door for an authorized attendant;

an array of linear dispensing modules within the cabinet, each module containing a front-to-back row of containers filled with a particular respective medicament; each module including means at a front end thereof to permit containers to be manually lifted out by the attendant one at a time, means for pushing the containers forward so that when one container is lifted out another container behind it is pushed into position for removal, and means for accounting for the number of containers in the respective module;

each of the modules having an associated signalling means that identifies to the attendant the module from which a container is to be taken to satisfy the patient prescription order; and a controller processor including means for inputting patient-medication information and providing a signal to the signalling means of the appropriate one of the modules in the cabinet containing the medicament prescribed for the patient;

wherein each said module includes guide means for holding said containers in a row and guiding them as they are pushed from back to front; a pusher mechanism biasing against a final one of said containers to push it forward; and a sensor device to track the position of the final one of said containers in the respective row.

8. Semi-automated pharmaceutical dispensing arrangement according to claims 7 wherein said sensor device includes a rotary sensor that rotates as said pusher mechanism moves forward.

9. Semi-automated pharmaceutical dispensing arrangement according to claim 8 wherein said rotary sensor includes a potentiometer.

10. Semi-automated pharmaceutical dispensing arrangement according to claim 8 wherein rotary sensor includes an encoder wheel.

11. Semi-automated pharmaceutical dispensing arrangement according to claim 7 wherein said sensor device includes a locator bar disposed proximally-distally on said mechanism and having teeth with a pitch corresponding to the thickness of the containers, and a sensor on said pusher mechanism that detects said teeth and spaces therebetween.

12. Semi-automated pharmaceutical dispensing arrangement for providing a medical/pharmacy attendant with one or more filled containers to satisfy a prescription order for a patient, comprising:

a cabinet having a housing, a front door, and a control mechanism opening the front door for an authorized attendant;

an array of linear dispensing modules within the cabinet, each module containing a front-to-back row of containers filled with a particular respective medicament; each module including means at a front end thereof to permit containers to be manually lifted out by the attendant one at a time, means for pushing the containers forward so that when one container is lifted out another container behind it is pushed into position for removal, and means for accounting for the number of containers in the respective module;

each of the modules having an associated signalling means that identifies to the attendant the module from which a container is to be taken to satisfy the patient prescription order; and a controller processor including means for inputting patient-medication information and providing a signal to the signalling means of the appropriate one of the modules in the cabinet containing the medicament prescribed for the patient wherein said sensor device includes a row of reflectors positioned on the dispensing mechanism at positions corresponding to positions of said containers, and a photodetector positioned on said pusher mechanism and oriented to have a field of view that travels along said row of reflectors as the pusher mechanism moves forward.

13. Method of semi-automatically dispensing prescribed medication from a container dispensing cabinet to fill a prescription order for a patient, comprising;

inputting into a controller-processor device patient-prescription information for said patient; said controller-processor device being operationally associated with said container dispensing cabinet, the latter having therewithin an array of linear dispensing modules, each module containing a front-to-back row of containers filled with a particular respective medicament; each module including means at a front end thereof to permit containers to be lifted out thereof one at a time, means for pushing the row of containers forward so that when one such container is lifted out another container therebehind is pushed into position for removal, and means for accounting for the number of containers remaining within the respective module; each of the modules having an associated signalling means that identifies to an attendant the module from which a container is to be taken to satisfy the patient's prescription; and lifting up and out a container from a front end of the respective row of each module for which said signalling means identifies that a container is to be taken.

14. The method of claim 13, further comprising scanning the container lifted out from the module with a bar code scanner to verify the container against the patient's prescription order.

15. A method of semi-automatically dispensing prescribed medication from a container dispensing cabinet to fill a prescription order for a patient, comprising:

inputting into a controller-processor device patient-prescription information for said patient; said controller-processor device being operationally associated with said container dispensing cabinet, the latter having therewithin an array of linear dispensing modules, each module containing a front-to-back row of containers filled with a particular respective medicament; each module including means at a front end thereof to permit containers to be lifted out thereof one at a time, means for pushing the row of containers forward so that when one such container is lifted out another container therebehind is pushed into position for removal, and means for accounting for the number of containers remaining within the respective module; each of the modules having an associated signalling means that identifies to an attendant the module from which a container is to be taken to satisfy the patient's prescription;

lifting out a container from each module for which said signalling means identifies that a container is to be taken; wherein a printer associated with said controller processor device prints a label containing patient prescription information when a container is lifted out from the indicated module; and applying said label to said container.

16. A method of semi-automatically dispensing prescribed medication from a container dispensing cabinet to fill a prescription order for a patient, comprising:

inputting into a controller-processor device patient-prescription information for said patient; said controller-processor device being operationally associated with said container dispensing cabinet, the latter having therewithin an array of linear dispensing modules, each module containing a front-to-back row of containers filled with a particular respective medicament; each module including means at a front end thereof to permit containers to be lifted out thereof one at a time, means for pushing the row of containers forward so that when one such container is lifted out another container therebehind is pushed into position for removal, and means for accounting for the number of containers remaining within the respective module; each of the modules having an associated signalling means that identifies to an attendant the module from which a container is to be taken to satisfy the patient's prescription;

lifting out a container from each module for which said signalling means identifies that a container is to be taken; and returning any containers lifted out by mistake from any of said modules into a return cabinet.

* * * * *